United States Patent [19]

Pozzobon et al.

[11] Patent Number: 4,728,115

[45] Date of Patent: Mar. 1, 1988

[54] CONCEALABLE SKI BINDING

[75] Inventors: Alessandro Pozzobon, Paderno Di Ponzano Veneto; Roberto Gorza, Pedavena, both of Italy

[73] Assignee: Nordica S.p.A., Montebelluna, Italy

[21] Appl. No.: 932,809

[22] Filed: Nov. 19, 1986

[30] Foreign Application Priority Data

Dec. 2, 1985 [IT] Italy ..... 23046 A/85

[51] Int. Cl.[4] ..... A63C 9/08

[52] U.S. Cl. ..... 280/613; 280/611

[58] Field of Search ..... 280/611, 612, 613, 616, 280/618, 628, 633, 634

[56] References Cited

U.S. PATENT DOCUMENTS 3,893,684 7/1975 Schweizer ..... 280/634

4,394,032 7/1983 Storandt et al. ..... 280/618

*Primary Examiner*—David M. Mitchell

*Assistant Examiner*—Brian L. Johnson

*Attorney, Agent, or Firm*—Guido Modiano; Albert Josif

[57] ABSTRACT

The ski binding comprises a body which can be fixed to a ski and is removably accomodatable in a recess provided in the lower face of the sole of a ski boot. The body defines a fixed coupling element which is engageable with a first abutment provided at one end of said recess and supports a movable coupling element which can move with respect to the body and is removably engageable with a second abutment provided at the other end of the recess. The movable coupling element is connected to a piston which is sealingly movable in a fluid chamber connected to a tank chamber, wherein an operating piston, is sealingly movable, and protrudes from said body, and interacts with a portion of the recess upon the application of the boot to the binding, to feed the fluid from the tank chamber to the fluid chamber, with consequent motion of the movable coupling element to engage with the second abutment.

11 Claims, 6 Drawing Figures

CONCEALABLE SKI BINDING

BACKGROUND OF THE INVENTION

The present invention relates to a concealable ski binding.

As is known, ski fastenings are already on the market which are commonly known as "concealable", which are structured in such a manner that they engage inside a recess defined in the lower face of the sole of a boot.

With known types of concealable bindings, notable difficulties are currently encountered regarding the possibility of operating the binding, both during the coupling phase and the uncoupling phase, since it is necessary to provide elements which are accessible externally of the engagement region of the boot, to allow the user to close or open the binding.

Furthermore, with known kinds of fastening devices, it is not always possible to perform safely and precisely the adjustment of the uncoupling force of the boot in the case of a fall or of any necessity.

Still another disadvantage which can be ascribed to the solutions of the prior art is that ski bindings, having an inherently mechanical operation, are easily subject to jamming, especially in the presence of infiltrations of snow or the like.

SUMMARY OF THE INVENTION

The aim proposed by the invention is indeed to eliminate the above described disadvantages by providing a ski binding of the concealable kind, wherein the operation during the coupling phase can be directly performed by simply applying the boot to the body of the fastening, obtaining in practice an automatic coupling which requires no further intervention on the part of the user.

Within the scope of the above described aim, a particular object of the invention is to provide a ski binding, of the concealable type, wherein the operating functions accessible from the exterior are reduced to a minimum, and are such as to not give rise to complex maneuvers on the part of the user.

Still another object of the present invention is to provide a ski binding of the concealable type, which allows the possibility of being calibrated with extreme precision, thus allowing the user to adjust, according to his requirements, the uncoupling force which allows the automatic uncoupling of the ski boot from the binding itself.

A further object of the present invention is to provide a ski binding which is structurally simple and which is designed so as to be practically free from jamming, since the mechanical parts are reduced to a minimum.

The above described aim, as well as the cited objects and others which will become apparent hereinafter, are achieved by a concealable ski binding, according to the invention, characterized in that it comprises a body, fixable to a ski and removably accommodatable in a recess defined on the lower face of the sole of a ski boot, said body defining a fixed coupling element, engageable with a first abutment provided at one end of said recess and supporting a movable coupling element, movable with respect to said body and releasably engageable with a second abutment provided at the other end of said recess, said movable coupling element being connected to a piston, sealingly movable in a fluid chamber connected to a tank chamber, wherein an operating piston is sealingly movable, said piston being adapted for protruding from said body, and for being pushed into said tank chamber by at least a portion of said recess, upon application of said boot to said binding, to feed fluid from said tank chamber into said fluid chamber, with consequent motion of said movable coupling element in engagement with said second abutment.

BRIEF DESCRIPTION OF THE DRAWINGS

Further characteristics and advantages will become apparent from the description of a preferred, but not exclusive, embodiment of a concealable ski binding, illustrated by way of example only in the accompanying drawings, wherein.

DESCRIPTION OF THE PREFERRED EMBODIMENTS

Figure 2:
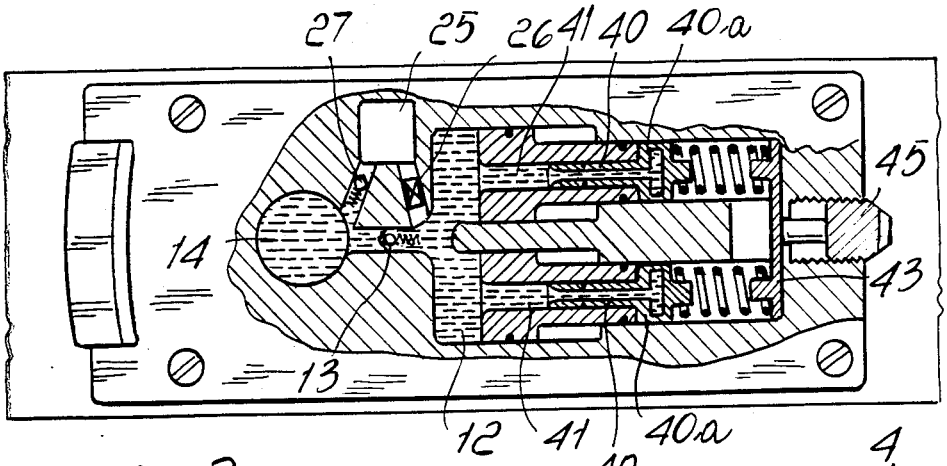
FIG. 2 is a partially cut-away view of the ski binding along a substantially horizontal plane.
Figure 1:
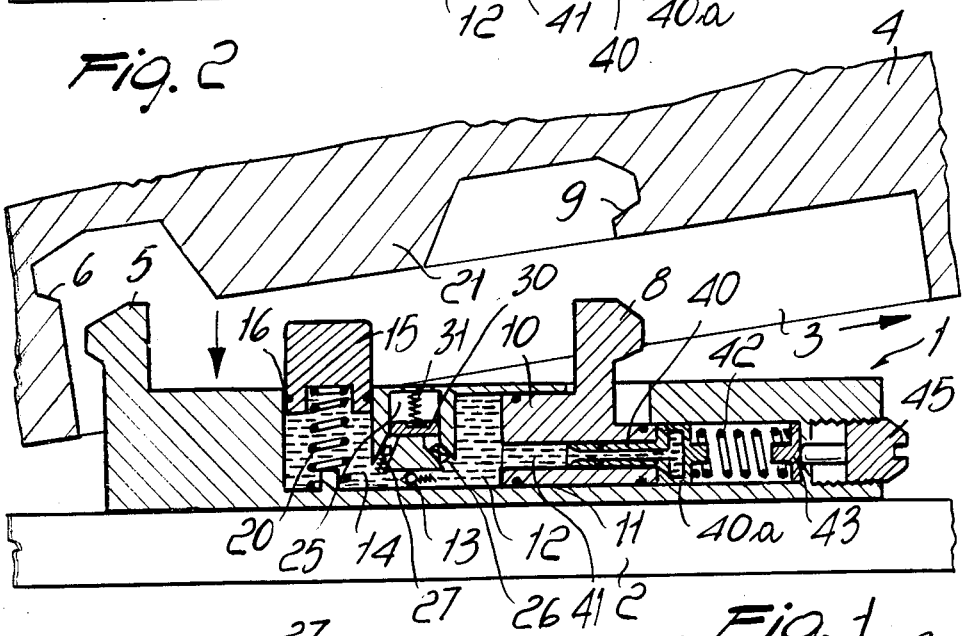
FIG. 1 is a schematic cross section view of the ski binding along a vertical plane to illustrate its component elements, at the moment of coupling with the ski boot.

With reference to the above described figures, the concealable ski binding, according to the invention, comprises a body, generally indicated by the reference numeral 1, which can be fixed, in a per se known manner, to a ski, schematically indicated by the reference numeral 2.

Said body 1 is removably associatable with a recess 3 which is provided in the lower face of the sole 4 of a ski boot.

Said body 1, at one of its ends, is provided with a fixed coupling element 5, substantially defining the shape of a tooth, which protrudes upwardly with respect to the body 1, and is removably engageable with a first abutment 6 having a matching configuration and being correspondingly defined at one end of said recess 3.

On the opposite side, the body 1 supports a movable coupling element 8, which also defines the shape of a tooth, and can be moved with respect to the longitudinal extension of the body 1 and is removably engageable with a second abutment 9 correspondingly defined in the cavity 3.

Said movable coupling element 8, which protrudes from body 1, is rigidly coupled with a first piston 10 which is sealingly movable, by virtue of the presence of annular gaskets 11, inside a fluid containing chamber 12, which fluid is preferably composed of oil or other incompressible fluid, which chamber is defined inside the body 1.

Said chamber 12 communicates, by means of a one-way valve 13, with a tank chamber 14, again defined by the body 1; the one-way valve 13 allows the flow of the fluid only from the tank chamber 14 to the chamber 12.

In the tank chamber 14, an operating piston 15 is provided, which is sealingly movable by virtue of the presence of the annular gasket 16 in the chamber 14, and which protrudes from the tank chamber 14 so as to protrude on the outside on the upper part of the body 1.

A spring 20 is provided which elastically pushes the operating piston 15, which acts between the lower face of the same piston and the bottom of the chamber 14.

The operating piston 15 is suitable for interacting with a portion of the recess 3 composed of a protrusion 21 which, upon the application of the boot to the binding, exerts a compressing action on the operating piston 15, pushing it inside the tank chamber 14, with the consequent transfer of fluid from the tank chamber 14 to the chamber 12.

The inflow of fluid into the chamber 12 gives rise to the motion of the piston 10, and, consequently, of the coupling element 8, which engages with the second abutment 9, performing the coupling between the boot and the fastener.

To allow the intentional uncoupling of the boot from the binding, an auxiliary chamber 25 is provided which communicates with the chamber 12 by means of a conduit controlled by auxiliary valve means operated from the exterior, which, in normal conditions, cut off the communication between the chamber 12 and the auxiliary chamber 25.

The auxiliary chamber 25 is in communication with the tank chamber 14 by means of second one-way valve means which allow the flow of fluid only from the auxiliary chamber 25 towards the tank chamber 14.

In the auxiliary chamber 25, a cap 30 can move, and is pushed by a helical spring 31 which acts between the same cap and the bottom of the chamber 30, which is intended to allow the inflow of fluid into the chamber when the controlled valve means 26 are acted upon, compressing the helical spring 31, and then expelling the fluid by means of the conduit controlled by the second valve means 27.

Inside the piston 10, one or more small pistons or release pistons 40 are provided, two in the accompanying example, which protrude from the piston 10 on the opposite part with respect to the chamber 12, and are intended to allow the automatic uncoupling in case of excessive stresses being exerted on the binding.

The small pistons 40 are sealingly movable in channels 41, defined by the body 1, and are elastically biased by calibration springs 42 connected to each other by means of a small crosspiece 43, on which an adjustment dowel 45 acts, which dowel is accessible from the exterior of the body 1 to adjust the elastic force exerted by the spring.

The small pistons 40 have, on the opposite side with respect to the chamber 12, an expansion **40*a*** which abuts against the end of the piston to push the same, as will be better described hereinafter, in an uncoupling position, in normal conditions.

Figure 3:
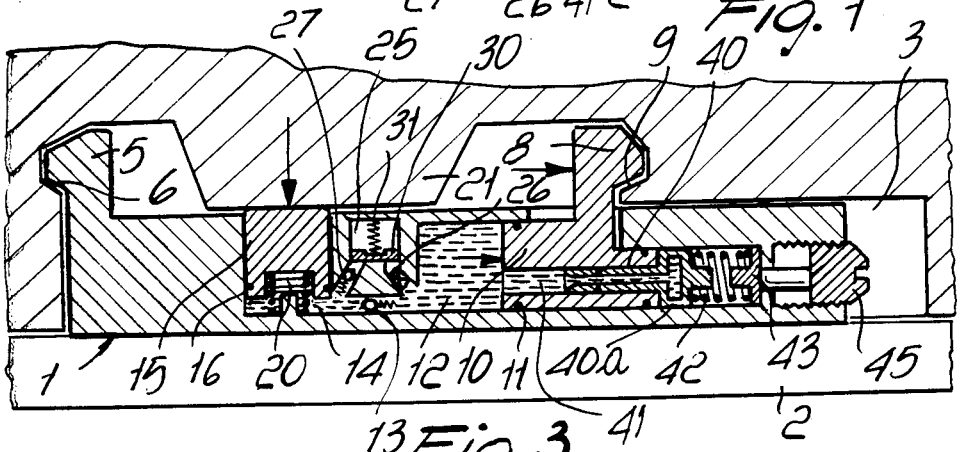
FIG. 3 is a cross section view of the coupling between the binding and the ski boot.
Figure 4:
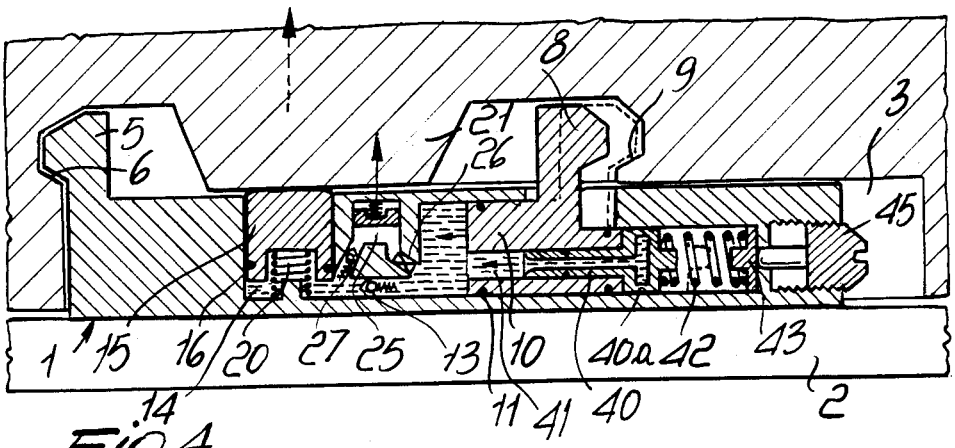
FIG. 4 is a cross section view illustrating the uncoupling of the boot from the ski binding.

In practical use, it occurs that in order to connect the boot to the binding it is sufficient to superimpose the boot, engaging the fixed coupling element with the abutment 6, then the pressure exerted by the protrusion 21 on the operating piston 15 gives rise to the reentry of the piston 15 inside the body 1 (FIG. 3), with the consequent motion of the piston 10 and locking engagement between the movable coupling element 8 and the second abutment 9.

In these conditions, it occurs that the boot is rigidly coupled to the binding.

When the user wishes to intentionally release the boot from the binding, he acts on the controlled valve means 26, by means of an external control, not illustrated in the drawings, giving rise to the communication between the auxiliary chamber 25 and the chamber 12.

In these conditions, the thrust exerted by the calibration springs 42 causes the backward motion of the piston 10 and the consequent inflow of fluid into the chamber 25, overcoming the elastic biasing force exerted by the helical spring 31 which causes motion of the cap 30 inside the chamber 25.

The backward motion of the piston 10 gives rise to the uncoupling of the movable coupling element from the second abutment 9, with the consequent possibility of raising the boot.

Figure 5:
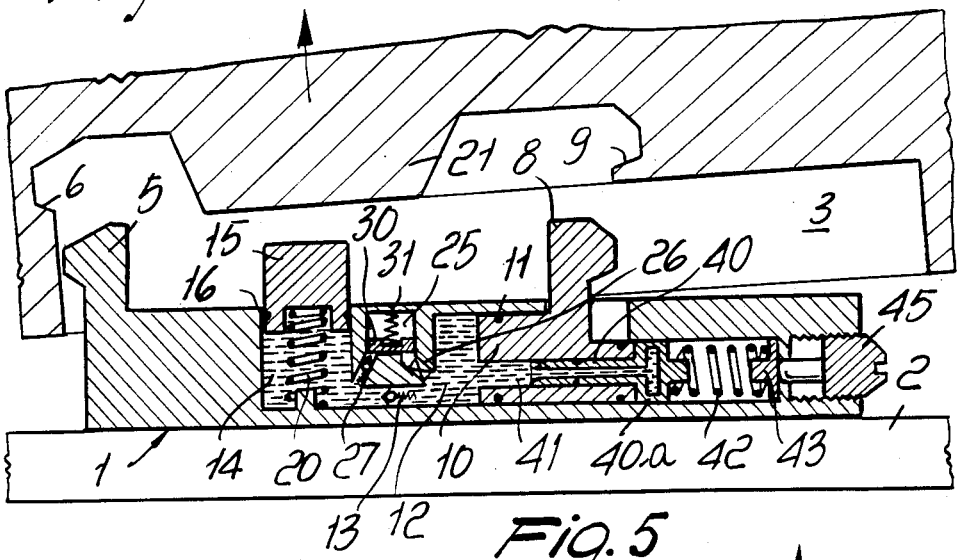
FIG. 5 is a cross section view of the binding uncoupled from the boot.
Figure 6:
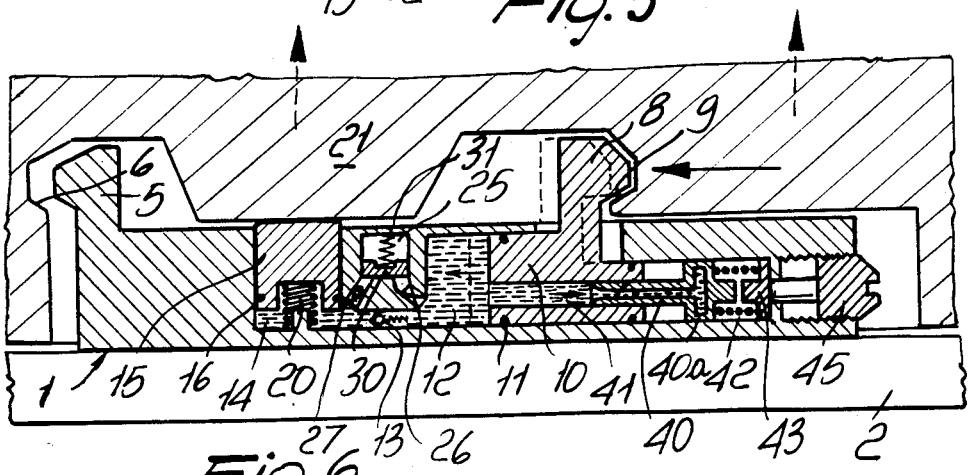
FIG. 6 is a schematic cross section view illustrating the automatic uncoupling from the binding in the case of high stresses.

By raising the boot, as is schematically illustrated in FIG. 5, the operating piston 15, pushed by the spring 20, protrudes on the exterior, returning to the tank chamber 14 the fluid which had entered the chamber 25, since the elastic biasing action exerted by the helical spring 31 overcomes the calibration of the one-way valve 27, with the consequent flow of the fluid.

In these conditions, the binding is returned to a ready condition for a new engagement.

In the case of excessive stresses, the automatic uncoupling of the binding occurs, since the thrust transmitted to the piston 10 by the movable coupling element 8 gives rise to the motion of the small pistons 40, overcoming the biasing force of the calibration springs 42 with an accumulation of fluid in the channels 41 and in the small pistons which protrude from the same channel.

The thrust exerted, with the consequent backward motion of the movable coupling element 8, releases the coupling between the fixed coupling element 5 and the abutment element 6, with the consequent uncoupling or release of the boot from the binding.

As previously mentioned, it is possible to adjust as required the automatic uncoupling force, i.e. the force which must be exerted to achieve the uncoupling in case of danger between the boot and the fastening, by calibrating as required the calibration springs 42, by acting on the dowel 45.

From what has been described, it can be seen therefore that the invention achieves the proposed aim and objects, and in particular the fact is stressed that a fastening of the concealable type is provided, the operation of which is fully hydraulic and employs the incompressibility of the fluid to perform the required operations.

Furthermore, the coupling occurs automatically by simply superimposing the boot on the fastening and exerting, by means of the operating piston 15, which is compressed, the pressure required to transfer the fluid from the chamber 14 to the chamber 12, with the consequent motion of the piston 10 and of the movable coupling element, which engages in a locking condition.

To perform the release or uncoupling, instead, an auxiliary accumulation chamber is employed, which allows the possibility of returning the fluid, once the uncoupling has been performed, into the tank chamber, thus returning the binding to the initial conditions, i.e. already preset for a subsequent coupling phase.

Similarly, also when the coupling occurs in an automatic manner the binding is already preset for a subsequent coupling phase, without any further adaption.

The invention thus conceived is susceptible to numerous modifications and variations, all of which fall within the scope of the inventive concept.

Furthermore, all the details can be replaced by other technically equivalent elements.

In practice, the materials employed, as well as the dimensions and the contingent shapes, may be any according to requirements.

We claim:

1. In combination, a concealable ski binding and a ski boot, said ski boot having a sole, said sole defining a lower face, said lower face having formed thereon a recess having at least one end and at least one other end, said at least one end of said recess having formed thereon at least one first abutment, said at least one other end of said recess having formed thereon at least one second abutment, said concealable ski binding comprising at least one body, at least one fixed coupling element, at least one movable coupling element, at least one first piston, at least one fluid containing chamber, at least one tank chamber, and at least one operating piston, said body being fixable to a ski and removably accommodatable in said recess, said fixed coupling element being defined on said body and adapted for engagement with said first abutment, said movable coupling element being supported by said body, adapted for releasable engagement relationship with said second abutment, and connected to said first piston, said first piston being sealingly movable in said fluid containing chamber, said fluid containing chamber communicating with said tank chamber, said operating piston being sealingly movable in said tank chamber and adapted for protruding from said body, said operating piston being further adapted to be pushed into said tank chamber by at least a portion of said recess upon application of said ski boot to said concealable ski binding, to feed fluid from said tank chamber into said fluid containing chamber with consequent motion of said movable coupling element, for causing said movable coupling to engage with said second abutment.

2. A combination according to claim 1, further comprising first one-way valve means, said first one-way valve means being adapted for allowing fluid to flow only from said tank chamber towards said fluid containing chamber.

3. A combination according to claim 1, further comprising at least one auxiliary chamber, auxiliary valve means, and second one-way valve means, said auxiliary valve means being externally operable, adapted for selectively communicating said auxiliary chamber with said fluid containing chamber, and adapted for selectively cutting-off said auxiliary chamber from said fluid containing chamber, said second one-way valve means being adapted for communicating said auxiliary chamber with said tank chamber and for allowing fluid to flow only from said auxiliary chamber towards said tank chamber.

4. A combination according to claim 3, further comprising at least one cap, and at least one helical spring, said cap being arranged in said auxiliary chamber, said helical spring being adapted for elastically pushing said cap for thrusting fluid from said auxiliary chamber towards said tank chamber.

5. A combination according to claim 1, wherein said operating piston has defined thereon a lower part, and wherein said tank chamber has a lower portion, said concealable ski binding further comprising at least one spring, said at least one spring being interposed between said lower part of said operating piston and said bottom portion of said tank chamber, for elastically extracting at least a portion of said operating piston from said tank chamber.

6. A combination according to claim 1, further comprising at least one release piston, and at least one channel, said channel being formed in said first piston and communicating with said fluid containing chamber, said release piston being slidably accommodated in said channel, said channel defining an end, said end of said channel being located remote from said fluid containing chamber, said release piston being extractable from said channel at said end remote from said fluid containing chamber.

7. A combination according to claim 1, further comprising at least two release pistons and at least two channels, said at least two channels being defined by said first piston, said at least two release pistons being slidably accommodated in said channels.

8. A combination according to claim 7, wherein said release pistons further comprise expansions, and wherein said first piston defines a side located remote from said fluid containing chamber, said expansions being adapted for abutment engagement relationship with said side of said first piston located remote from said fluid containing chamber.

9. A combination according to claim 7, further comprising calibration springs, at least one crosspiece, and at least one adjustment dowel, said calibration springs each having at least one end and at least one other end, said adjustment dowel being supported by said body and externally accessible, said at least one end of each of said calibration springs acting on said at least one of said release pistons, said at least one other end of each of said calibration springs acting on said crosspiece, said crosspiece in turn acting on said adjustment dowel.

10. A combination according to claim 3, further comprising at least one cap, at least one helical spring, calibration springs, at least one crosspiece, and at least one adjustment dowel, said cap being arranged in said auxiliary chamber, said helical spring being adapted for exerting an elastic biasing force for elastically pushing said cap for thrusting fluid from said auxiliary chamber towards said tank chamber, said calibration springs each having at least one end and at least one other end, said adjustment dowel being supported by said body and externally accessible, said at least one end of each of said calibration springs acting on said at least one of said release pistons, said at least one other end of each of said calibration springs acting on said crosspiece, said crosspiece in turn acting on said adjustment dowel, said calibration springs being adapted for overcoming said elastic biasing force exerted by said helical spring upon actuation of said auxiliary valve means, when said concealable binding is intentionally uncoupled from said ski boot.

11. A combination according to claim 7, wherein said release pistons are adapted to protrude from said channels defined by said first piston and said first piston is adapted to move rearwardly to permit uncoupling of said fixed coupling element from said first abutment upon dangerous stresses being exerted on said first piston.

* * * * *